US006441748B1

(12) United States Patent
Takagi et al.

(10) Patent No.: US 6,441,748 B1
(45) Date of Patent: Aug. 27, 2002

(54) ROAD SURFACE CONDITION MONITORING SYSTEM USING SENSORS DISPOSED UNDER THE ROAD

(75) Inventors: Masahito Takagi, Cambridge; Ichiro Masaki, Boxboro, both of MA (US)

(73) Assignees: Yokogawa Electric Corporation, Tokyo (JP); Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/824,507

(22) Filed: Apr. 2, 2001

(51) Int. Cl.[7] ..... G08G 1/00

(52) U.S. Cl. ..... 340/901; 340/580; 340/905; 340/962; 324/634; 324/689

(58) Field of Search ..... 340/901, 905, 340/580, 903, 581, 962; 324/688, 689, 693, 671, 633, 634, 635; 73/170.26

(56) References Cited

U.S. PATENT DOCUMENTS 4,897,597 A * 1/1990 Whitener ..... 324/693
4,996,493 A * 2/1991 Monat et al. ..... 324/699
5,686,841 A * 11/1997 Stolarczyk et al. ..... 324/635
5,710,554 A * 1/1998 Pettler et al. ..... 340/905
5,729,214 A * 3/1998 Moore ..... 340/905
5,801,647 A * 9/1998 Survo et al. ..... 340/905
5,852,243 A * 12/1998 Change et al. ..... 73/659
6,133,854 A * 10/2000 Yee et al. ..... 340/907

* cited by examiner

*Primary Examiner*—Jeffery Hofsass
*Assistant Examiner*—Davetta W. Goins
(74) *Attorney, Agent, or Firm*—Moonray Kojima

(57) ABSTRACT

A road surface monitoring system for monitoring the condition of a road surface wherein at least one sensor unit is interchangeably provided in a sealed container disposed below the road surface and a power source is provided to power the sensor unit, and a communications device is provided to obtain measurement and/or monitoring data from the at least one sensor unit and to provide control signals to the at least one sensor unit, whereby an inexpensive and readily maintainable system is provided.

15 Claims, 4 Drawing Sheets

ROAD SURFACE CONDITION MONITORING SYSTEM USING SENSORS DISPOSED UNDER THE ROAD

BACKGROUND OF THE INVENTION

1. Field of Invention

This invention relates to a system for monitoring the condition of a road surface, and more particularly, to such a system using one or more sensors disposed under the road surface and being readily interchangeable.

2. Description of the Prior Art

Management of vehicle traffic and safety is no longer a luxury, but, instead is a necessity, especially in urban areas where the density of traffic is substantial. Effective traffic management requires up to date information on the condition of the road surface at specific locations of the road. The road conditions which need constant measurement and monitoring are, for example, the moisture content, the dryness, the presence or absence of snow and/or ice, and the depth thereof, temperature, etc.

Current conventional road surface monitoring systems generally rely upon sensor units being disposed on poles located adjacent to the road. These conventional systems are expensive to maintain and replace, and are difficult to access.

SUMMARY OF THE INVENTION

Accordingly, an object of the invention is to overcome the aforementioned and other disadvantages, problems and deficiencies of the prior art. The foregoing and other objects are attained by the invention which encompasses a road condition monitoring system comprising one or more sensor units interchangeably disposed in a container which is disposed under the surface of a road, the units each comprising a specific sensor for measuring and/or monitoring a physical value of a particular condition, such as rain, snow, depth of snow, ice, etc, means for powering the one or more sensor units, and means for communicating the measured and/or monitored condition to an external station and for receiving control signals therefrom.

Another feature of the invention is placement of a power supply within the container.

A further feature is the use of an external power to drive the various units contained in the container.

Another feature is the use of a wire or wireless transmitter and/or receiver for the sensor units and contained within the container.

A further feature is the use of connectors to connect the various units contained within the container to other devices.

A yet further feature is the use of a communicating means for transmitting signals from the sensor units by wireless transmission or wire transmission to external stations.

Another feature is the use of unique address or identification codes for each container located under the road surface so as to enable exact location of a particular road surface being measured.

Another feature is the use of differential GPS units in the container to transmit to a vehicle road surface condition signals from the sensor units in the container.

Another feature is the use of a visible display signal disposed on a pole located adjacent to and/or over the road, to display road surface conditions.

A further feature is that the sensor units may comprise a laser radar sensor, a load moisture sensor, an optical sensor, a radiometer, an ultrasonic snow depth sensor, a thermometer, or a rain gauge.

DETAILED DESCRIPTION OF PREFERRED EMBODIMENTS

Figure 6:
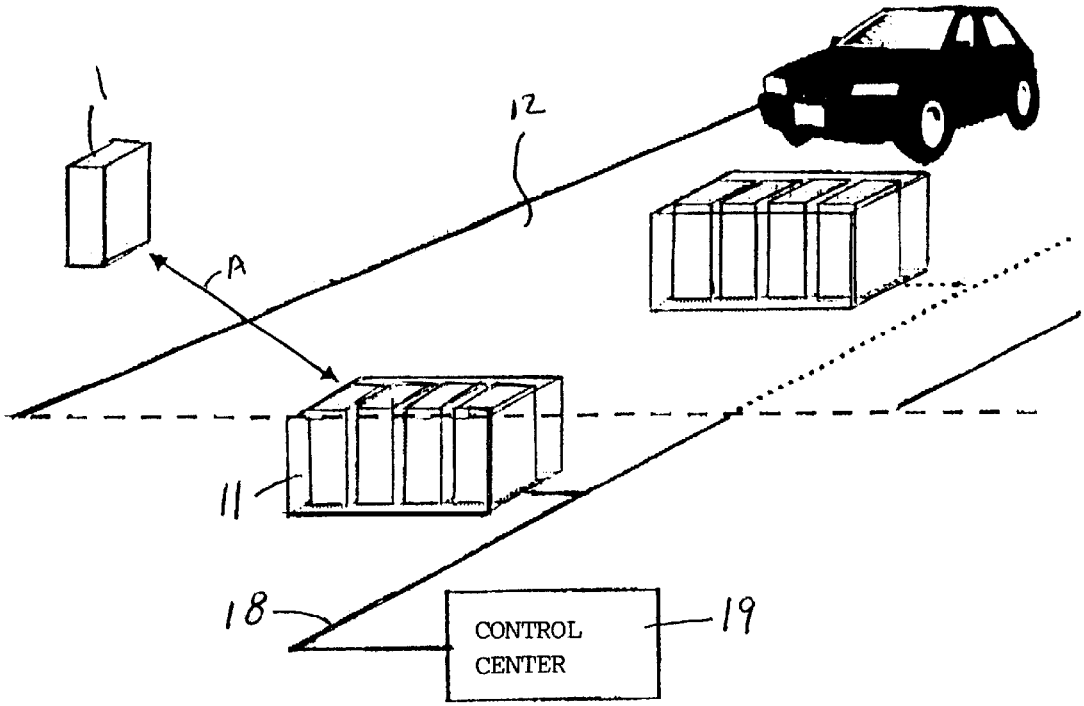
FIG. 6 is a perspective view depicting placement of two containers of FIG. 5 under the road and as connected to a control center.
Figure 8:
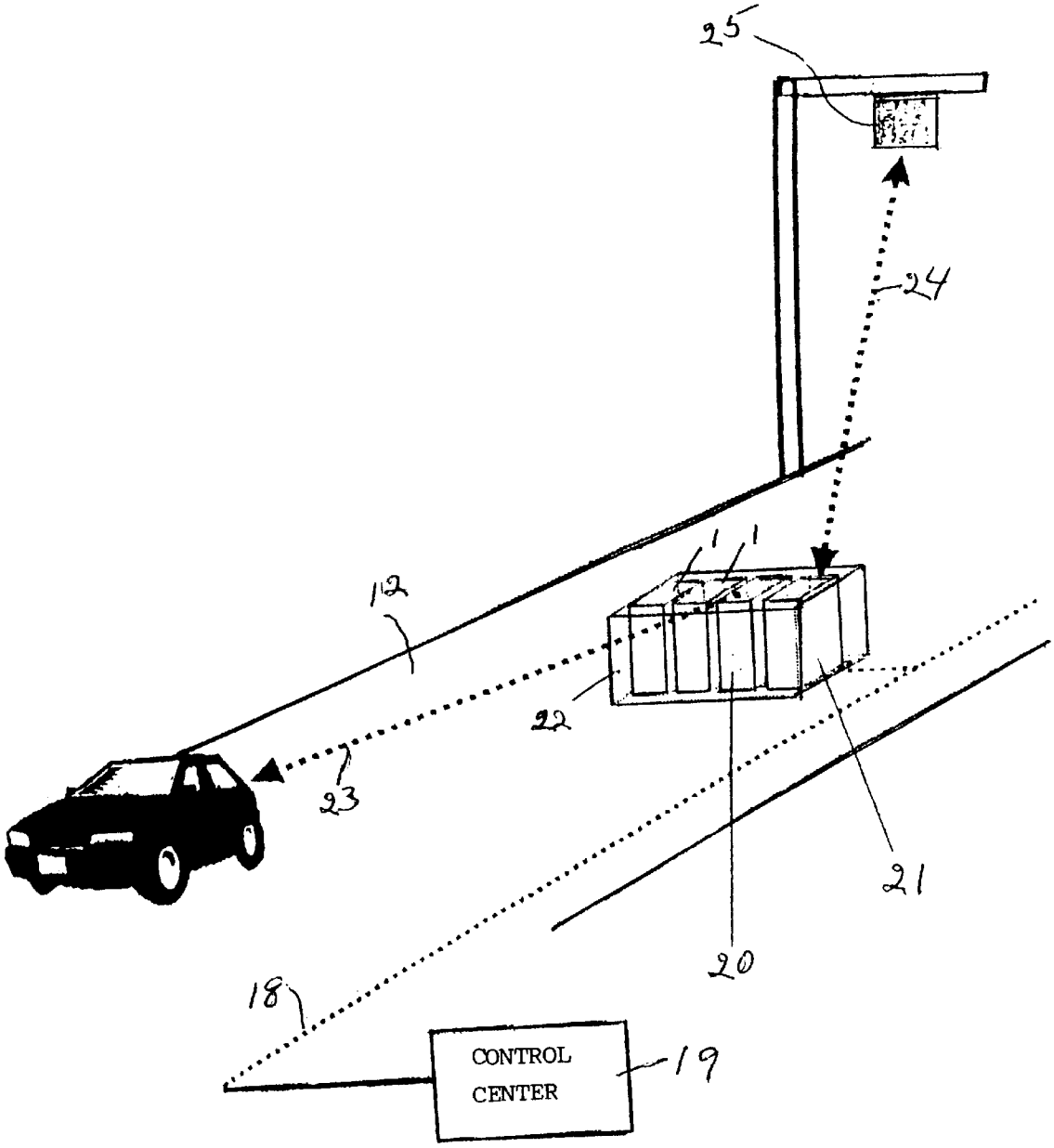
FIG. 8 is a perspective view depicting the container of FIG. 7 disposed under the road surface and connected to a control center.

In the following figures, various perspective views are shown, but with a slight modification of drafting principles, namely, the interiors are mostly shown with full lines instead of broken lines to more clearly show the interior content. In FIGS. 6 and 8, the network connection 18 under the road 12 is shown with dotted or broken lines. The network, of course, can be accessed by wireless communication and/or wired communication.

Figure 3:
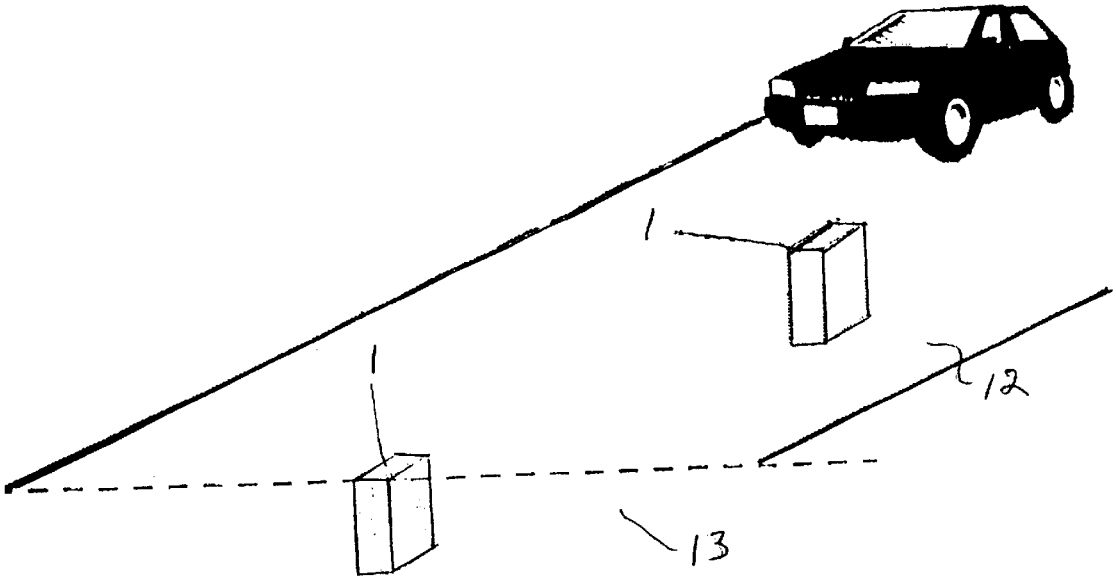
FIG. 3 is a perspective view depicting a road surface and placement of a pair of sensor units thereunder.

The invention encompasses at least one sensor unit 1, disposed under the surface of road 12, as shown in FIG. 3. In FIG. 3, the road is shown partially in cross section by symbol 13.

Figure 1:
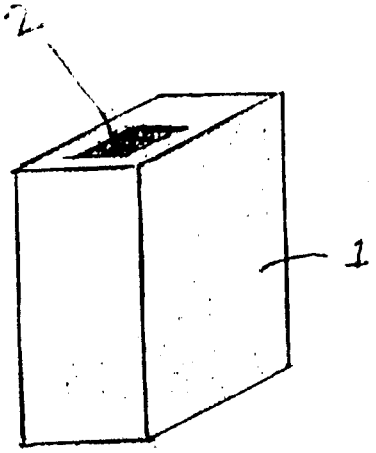
FIG. 1 is a perspective view depicting a sensor unit.

As shown in FIG. 1, the sensor unit 1 comprises a sensor 2 disposed within the sensor unit 1. The sensor 2 measures one or more physical values of the road surface condition. For example, the sensor may comprises a laser radar sensor, a load moisture sensor an optical sensor, a radiometer sensor, an ultrasonic snow depth sensor, a thermometer, a rain guage, etc. These will be used to measure and monitor such conditions as presence or absence of rain, moisture, dryness, snow,snow depth, ice, ice depth, etc.

Figure 5:
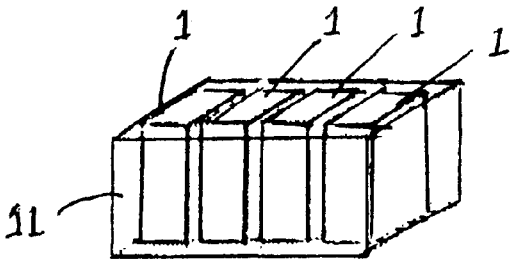
FIG. 5 is a perspective view depicting the container of FIG. 4 with the sensor units being fitted thereinto.
Figure 4:
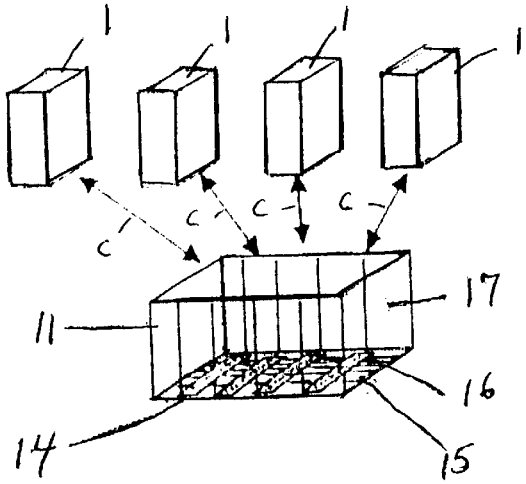
FIG. 4 is a perspective view depicting a container and a plurality of sensor units which are interchangeably fitted thereinto with the sensor units being shown outside the container.

The sensor unit 1 can be readily interchanged by placing within slots provided in container 11 , as shown in FIG. 5. In FIG. 4, the container 11 is shown having slots 17, into which sensor units 1, are fitted, and interchanged, as indicated by double arrows C. Also, container 11 comprises connectors 14, a power bus 15, and signal bus 16, which will be discussed further hereinbelow. The sensor units 1 are sealed and when contained within container 11, the container 11 is also sealed from exposure to the elements.

Figure 7:
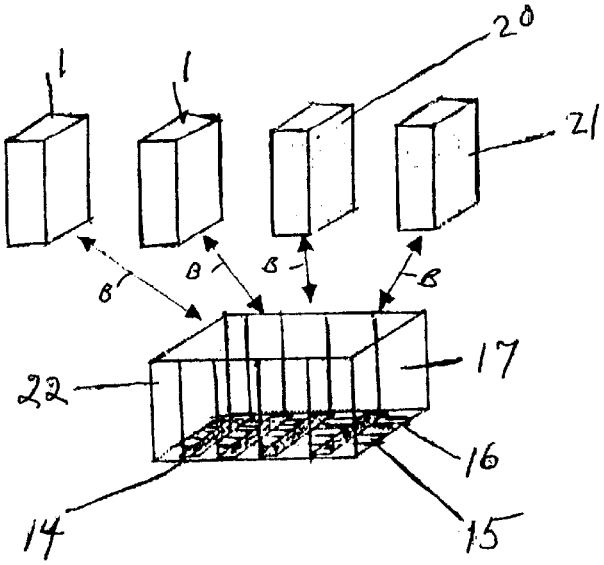
FIG. 7 is a perspective view depicting another container and a plurality of sensor units and a communication unit and a Differential GPS (Global Positioning System) unit.

Advantageously, the container 11 is disposed below the surface of the road, and preferably in the roadway 12, with access being provided thereto so that with simplicity and ease, the container 11 can be opened, and one or more of the sensor units 1 (and other types of units, as shown in FIG. 7) can be readily interchanged by pulling one unit out and placing another similar unit in the same slot, and then closing the container to keep same sealed against exposure to the elements. An advantage to this invention is that with simple interchange of sensor units (and/or other units of types such as shown in FIG. 7) the monitoring system can be inexpensively maintained.

Returning to FIG. 4, connectors 14 are shown so as to enable connection of one or more units disposed in slot 17 to external units. Moreover, a power bus 15 is provided so as to enable providing of power to the sensor units 1 and other units 20,21 of FIG. 7, for example. The power source can be provided by an external source i.e. external to the container 11, or by a source internal to container 11. It is also possible to have the power source provided internally of one or more of the sensor or other units. The signal bus 16 provides for bilateral provision of communication to and from the sensor and other units to and from external units, as will be discussed further hereinbelow.

Figure 2:
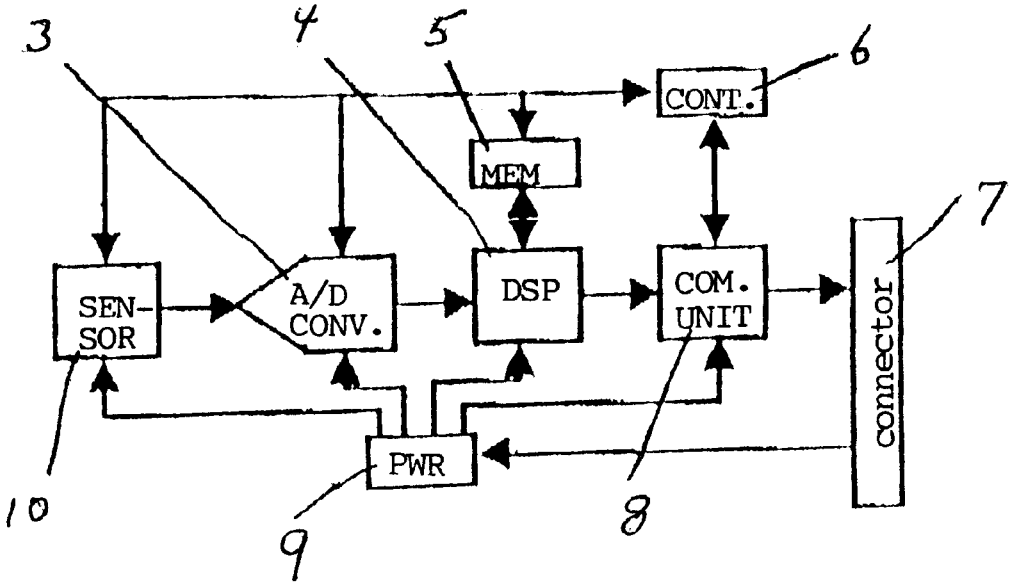
FIG. 2 is a block diagram depicting the components of a sensor unit.

FIG. 2 shows the electrical components used to operate the sensor unit 10 and comprises an analog to digital (A/D) converter 3, a digital signal processor (DSP) 4, a memory 5, a controller 6, a connector 7, a communication unit 8, and a power source 9. As previously discussed, the power source and/or communication unit can be within the container or outside the container or within one or more of the sensor or other units which are fitted within the container or outside such sensor other units, and connectable through connnector 7 to the outside. Also, the other circuits for operating and obtaining data from the sensor 10, such as the A/D converter 3, the DSP 4, memory 5, and controller 6, can be disposed within each of the sensor units 1, or within container 11, or located in an externally placed device. The DSP 4 can be a CPU.

In operation, power is suppled to the circuitry involved by power source 9. The sensor 10 then senses the particular physical value, such as depth of snow, assigned thereto. The data is then sent from the sensor to the A/D converter which converts the analog data from the sensor 10 into digital signals, which are then sent to the DSP, 4, and therefrom to the memory 5 for storage. Also, the data is sent to communication unit 8, which under control of controller 6 then sends out the data by wire or wireless transmissions through for example, connector 7.

When a particular sensor unit is desired to be accessed, an external control center will contact that sensor unit through connector 7 and communication unit 8, and under control of controller 6, cause sensor 10 to take a reading of the particular surface condition assigned thereto. Then, the sensor 10 takes the reading, and sends the data of the reading to the A/D converter, as discussed above, to transmit the monitoring information to an external center.

In another access method, the particular sensor 10 is accessed by the external control center, and the data contained in memory 5 is sent to the external control center, through the DSP 4, and communication unit 8 and connector 7.

Thus, advantageously, the inventive monitoring system has great flexibility, as to the different components of the sensor unit, the power unit, and the communication unit, which can be used and the placement of each unit. Moreover, each of the different units can be disposed interchangeably in container 11 by simple replacement within slots contained therein. For example, the control and access can be done by wire connections or by wireless connections. Also, the power can be provided externally of the container and/or sensor and other unts , or provided internally therein. Moreover, the communications between the sensor and other units and an external control station can be by wire or wireless communication.

To recapulate, the sensor unit(s) 1 are disposed under the surface of the road 12, as shown in FIG. 3 for easy access, and more flexible sensing of road conditions. As shown in FIG. 5, a plurality of sensor units 1 , which as shown in FIG. 1, have sensors 2 therein, are placed in slots within and held therein in container 11, as shown in FIG. 5. The sensor units 1, as shown in FIG. 4, are readily removable and replaceable into and from container 11, as shown by double arrows C, within slots 17, and communication devices and power devices are connectable to buses 16 and 15, and connectors 14 are provided for connecting various devices thereto.

Turning to FIG. 6, the container(s) 11 having the sensors 1 interchangeably disposed and removable therefrom, as shown by double arrow A, are disposed below the surface of road 12, and connectable through network 18 to control center 19. The network 18 is connectable through wired or wireless communication means. The control center may be localized or at a distance from the location of the container 11 of sensor units 1. The control center 19 can provide power for the containers 11, and control signals to determine when the sensor(s) units are operated to take measurements and/or monitor conditions, and for obtaining therefrom data on the measurements and/or conditions of the surface of the road 12. The signals used to trigger the sensors to operate,and to cause data therefrom or from a memory 5 of FIG. 2, to be transmitted to the control center, may be transmitted and/or received by wire transmission or by wireless transmission, as desired.

The container 22, as shown in FIG. 7, may contain other units 20 and 21, in place of two of the sensor units 1, and be interchangeable, as shown by double arrows B, into slots 17, similar to the fitting of units in container 11, of FIG. 4. Similar to FIG. 4, in FIG. 7, there is also provided connector 14, communication bus 16 and power bus 15.

Also, similar to FIG. 6, the container 22 is buried in the road 12 under the surface thereof , as shown in FIG.8. The difference between FIG. 6 and FIG. 8 is that in FIG. 8, communication unit 20, which is a wireless communication unit, sends signals through wireless transmission 24, to a display unit 25 disposed, for example, on a pole placed adjacent and/or over road 12. Also, in FIG. 8, Differential GPS unit sends navagiational and road condition signals through wireless transmission 23 to a vehicle.

Similar to FIG. 6, the wireless or wire transmission to a network 18 and then through to the control center 19 are in addition to the wireless transmission to display 25 and to the vehicle.

Returning to FIG. 7, in place of one sensor unit 1, such as shown in FIG. 4, a Differential GPS (global positioning system) unit 20 is disposed in a corresponding slot 17. The differential GPS unit provides wireless transmission of global positioning data and signals related to the road surface conditions as sensed by the sensor units 1. Currently, GPS receivers are provided in many luxury cars, and with slight revision, the receivers can receive data on the road surface conditions as sent by the sensor unit 1. Also, in place of another sensor unit 1, a wireless communication unit 21 is provided to send the data on road surface condition to display unit 25 provided on a pole over and/or adjacent to roadway 12. Thus, the road condition can be visibly displayed on a display unit above the road. For example, an icy condition a certain distance from the sign 25 can be signaled in the display 25, with wireless communication unit 21 sending the data to the signal 25.

The differential GPS unit can instead be a RTK-GPS unit which can be used in place of unit 20 and the transmission may be wireless, such as by radio or laser. "RTK" is short for Real Time Kinematics.

In each container 11 or 22, an identification code or other unique address may be assigned so that data carrying such identifica-code of unique addres will readily identify the exact location of that particular container, and hence, the exact part of the road 12 being measured and/or monitored is made known. In this manner, whether by wire or wireless transmission, and regardless of the location of the external control center, it will be made know to the person desiring the information on road condition that the road condition is as measured and/or monitored, and that such road condition exits for a particular location of the road surface.

The invention thus provides an inexpensive and easily maintainable system for measuring and/or monitoring the surface condition(s) of a road. Individual sensor units, communication units, GPS units, access means and power means, can all be interchangeably replaced with ease and increased reliability. The sensor means and the communication can be cassettes which are fitted into slots in the container which is located below the surface of a roadway with access to the container being sealed and being readily opened and closed. The various units can be accessed from a central location to determine any problems, and where there is a problem, one or more units can be readily replaced by a new unit. No clumsy and dangerous climbing of poles is required to change damaged units. Also, the different units having different functions can be used in the same container.

The foregoing description is illustrative of the principles of the invention. Numerous extensions and modifications thereof would be apparent to the worker skilled in the art. All such extensions and modifications are to be considered as part and parcel of the invention.

What is claimed is:

1. A system of monitoring conditions of a road surface, said system comprising:

a sealed container disposed under said road surface and having a structure comprising a top, a bottom, a plurality of sides, and a plurality of parallel slots disposed between said top and bottom and between at least two of said sides;

a plurality of sealed sensor units each sensor unit detecting a different road condition interchangeably fitted within said plurality of parallel slots in said sealed continer;

means for supplying power to said plurality of sealed sensor units; and means for communicating between said plurality of sealed sensor units and an external station.

2. The system of claim 1, wherein said plurality of sealed sensor units comprise means for sensing wetness, means for sensing temperature, means for sensing dryness, and means for sensing depth of snow or ice.

3. The system of claim 1, wherein said means for supply power is disposed within said container.

4. The system of claim 1, wherein said means for supplying power is disposed outside said container.

5. The system of claim 1, wherein said means for communicating comprises a wireless transmitter means disposed within said container.

6. The system of claim 1, wherein said means for communicating comprises a wireless receiver means disposed within said container.

7. The system of claim 1, wherein said means for communicating comprises a differential GPS transmitter and/or receiver.

8. The system of claim 1, wherein said container comprises connector means for connecting said communicating means with an external station.

9. The system of claim 1, wherein said communicating mens comprises means for transmitting measured signals from said at least one sensor means and means for receiving signals from said external station through a network.

10. The system of claim 1, wherein said container contains means for providing a unique address or identification code for that particular container.

11. The system of claim 1, wherein said communicating means comprises a differential GPS transmitter for transmitting a differential GPS navigational data signal to a vehicle on said road surface.

12. The system of claim 1, further comprising means adjacent to said road for displaying data from said at least one sensor unit as communicated by said communicating means.

13. The system of claim 11,wherein said vehicle has therein a GPS receiver for receiving data regarding locating of a particular sensor unit and the particular road location at which that particular sensor unit is located.

14. The system of claim 1, wherein said at least one sensor comprises a laser radar sensor, a load moisture sensor, an optical sensor, a radiometer, an ultrasonic snow depth sensor, a thermometer sensor, or a rain gauge sensor.

15. The system of claim 1, wherein said means for communicating comprises a RTK-GPS transmitter and/or receiver.

* * * * *